US005195550A

United States Patent [19]

Chan

[11] Patent Number: 5,195,550

[45] Date of Patent: Mar. 23, 1993

[54] UMBRELLA

[76] Inventor: John C. Y. Chan, 14/E Flat C, 459-469 Castle Peak Road, Wah Lik Ind. Bldg., Tsuen Wan, N.T., Hong Kong

[21] Appl. No.: 641,642

[22] Filed: Jan. 15, 1991

Related U.S. Application Data

[63] Continuation-in-part of Ser. No. 578,252, Sep. 6, 1990, abandoned.

[51] Int. Cl.[5] ..... A45B 25/28

[52] U.S. Cl. ..... 135/48; 135/15.1; 403/51

[58] Field of Search ..... 135/48, 34.2, 33.6, 135/15.1; 403/50, 51; 285/901

[56] References Cited

U.S. PATENT DOCUMENTS

| | | | |
|---|---|---|---|
| 110,452 | 12/1870 | Fowler | 135/48 |
| 337,145 | 3/1886 | Ghezzi | 135/34.2 X |
| 348,600 | 9/1886 | Taber | 135/48 |
| 515,636 | 2/1894 | Whitaker | 135/48 |
| 688,145 | 12/1901 | Winter | 135/48 |
| 750,553 | 1/1904 | Miller | 135/34.2 |
| 976,032 | 11/1910 | Bluff | 135/48 |
| 1,068,566 | 7/1913 | Chavarria | 135/48 |
| 1,110,215 | 9/1914 | Madonna | 135/48 |
| 1,373,642 | 4/1921 | Airey et al. . | |
| 2,427,188 | 9/1947 | Bossart . | |
| 2,545,022 | 3/1951 | Crewdson | 135/34.2 |
| 2,838,058 | 6/1958 | Foltis et al. | 135/48 |
| 3,809,107 | 5/1974 | Liu . | |
| 4,703,768 | 11/1987 | Lee . | |

FOREIGN PATENT DOCUMENTS

| | | | |
|---|---|---|---|
| 218729 | 8/1957 | Australia | 135/48 |
| 2587600 | 3/1987 | France | 135/34.2 |
| 309412 | 7/1933 | Italy | 135/48 |
| 339364 | 11/1936 | Italy | 135/34.2 |
| 341412 | 12/1936 | Italy | 135/34.2 |
| 57-27924 | 2/1982 | Japan | 135/34.2 |
| 59-21215 | 2/1984 | Japan | 135/34.2 |
| 60-120622 | 8/1985 | Japan | 135/34.2 |
| 2126803 | 5/1990 | Japan | 135/34.2 |
| 447493 | 3/1968 | Switzerland | 135/48 |

*Primary Examiner*—Richard E. Chilcot, Jr.
*Assistant Examiner*—Lan M. Mai

[57] ABSTRACT

An umbrella comprises a drain cup for collecting rainwater draining down the umbrella after use thereof, and a cover in the form of an accordion or bellows structure one end of which is connected to the drain cup and which may be contracted during use of the umbrella and extended after use thereof so as to contain rainwater and so as to guide the rainwater to the drain cup.

12 Claims, 3 Drawing Sheets

UMBRELLA

This is a continuation-in-part of application Ser. No. 07/578,252, filed Sep. 6, 1990, now abandoned.

BACKGROUND OF THE INVENTION

The invention relates to umbrellas.

A disadvantage with conventional umbrellas is that when the user reaches his destination, the wet umbrella may prove an inconvenience. This problem arises particularly when the user reaches a public place such as a restaurant or office which does not have an umbrella stand so that the rainwater drips onto the floor, or when the user enters a vehicle and the rainwater drips onto the floor of the vehicle or onto the clothes of the user or other occupants of the vehicle.

It has been proposed to provide a drip cup adjacent the tip of an umbrella to collect rainwater dripping down. Drip cups are described in U.S. Pat. Nos. 976,032 (J. T. Bluff), 1,068,566 (F. H. Chavarria), 1,110,215 (C. J. Madonna), 1,373,642 (W. E. Airey and J. Pomfret), 2,427,188 (A. Bossart), 3,809,107 (Liu) and 4,703,768 (Lee), and also in Italian Pat. No. 309412 (Romagnoli) and Australian Pat. No. 218,729 (Magini). Drip cups, however, suffer from certain disadvantages. One disadvantage is that when the umbrella is folded it is not always possible to maintain the umbrella precisely vertically and therefore not all the rainwater on the fabric of the umbrella will drip down into the drain cup. One situation in which the folded umbrella is not held vertically arises when the umbrella is folded on entering a building, but the user walks some distance through the building before reaching his final destination. As the user walks along through the building the folded umbrella undergoes oscillatory motion, spraying rainwater onto the floor of the building. Another situation in which the umbrella is not held vertically arises when the user enters a vehicle. The limited space available in the vehicle and the motion of the vehicle prevent the folded umbrella being held upright. Also, the wet umbrella fabric wets the clothes of the user or other nearby persons. Another disadvantage with drain cups is that the rainwater which does collect in the drain cup may be accidentally spilled from the drain cup before an opportunity arises to empty the drain cup.

It has also been proposed to provided an umbrella with a drain cup and an umbrella cover which can be contracted towards the drain cup when the frame and fabric of the umbrella are to be opened out for use and which can be extended along the umbrella when the frame is collapsed and the fabric is folded after use so as to guide rainwater to the drain cup. U.S. Pat. No. 337,145 (R. E. Ghezzi) discloses an umbrella provided with a cover which can be contracted or extended, and consists of a telescopic casing made from a series of tubes which can be telescoped into one another. The telescopic casing proposed in the Ghezzi patent would solve the above described problems which arise with drain cups but the telescopic casing is impracticable for a number of reasons. Firstly, immediately after use of the umbrella, with the umbrella frame collapsed and the umbrella fabric in an unfolded state and swollen by moisture, considerable friction would be encountered in moving the telescopic casing to the extended position. As a result of the friction it would take an appreciable time for the user to extend the cover, and if the user were to extend the cover in preparation for entering a vehicle, the user would become wet during the time taken. A similar problem would arise in alighting from a vehicle. Furthermore, in folding the fabric before extending the telescopic casing and in extending the telescopic cover, after gripping the movable end of the telescopic casing, the user's hand would come into contact with the fabric of the umbrella, the user's hand becoming wet in the course of these operations, which is not desirable in certain circumstances such as for example when the user is bearing or is about to handle documents. Also, as the telescopic casing is extended along the umbrella, the leading edge of the telescopic casing would push rainwater ahead of it along the fabric of the umbrella spraying rainwater instead of trapping it. In addition, as a result of the friction the user would need to grip the umbrella very firmly in both hands in order to extend the telescopic casing, and this firm gripping in both hands would generally require the user to hold the umbrella horizontally thereby spraying rainwater. Finally, extending the telescopic casing would cause considerable wear and tear to the fabric of the umbrella which would rapidly lose its waterproof properites. A second disadvantage with the telescopic casing is that rainwater may leak out of the extended casing through the joints between the telescopic sections.

An object of the present invention is to provide an umbrella with an improved and more practical retractable cover.

SUMMARY OF THE INVENTION

The invention provides an umbrella provided with a retractable cover having an accordeon or bellows structure. The invention also provides an attachment for an umbrella, the attachment comprising a retractable cover having an accordion or bellows structure. Other objects and advantages of the invention will become apparent from the detailed description which follows.

DETAILED DESCRIPTION OF THE INVENTION

Figure 4:
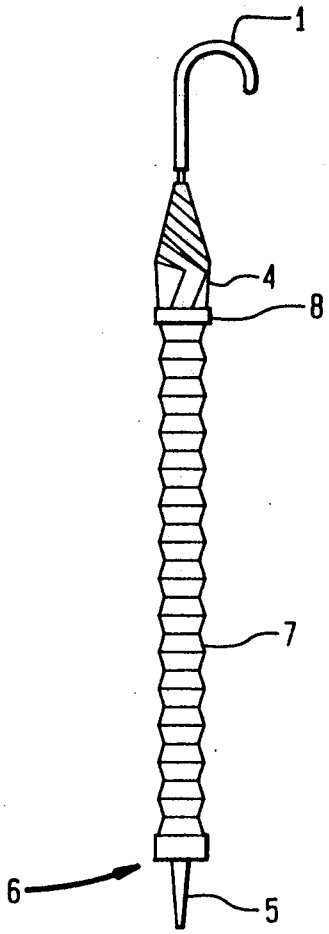
FIG. 4 is an elevation of the umbrella after use, in the folded condition and with the cover fully extended.

Referring to the drawings the umbrella comprises a handle 1, a shaft 2, a collapsable umbrella frame 3, umbrella fabric 4 and an umbrella tip 5.

The umbrella is provided with a drain cup 6, a retractable cover 7 and a hand trip 8 at the movable end of the retractable cover. The hand grip 8 is connected to the movable end of the retractable cover 7 so that the hand grip can rotate relative to the retractable cover.

Figure 3:
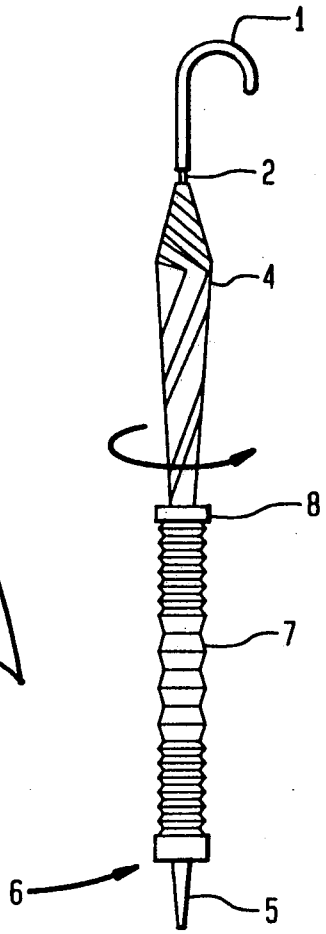
FIG. 3 is an elevation of the umbrella after use, in the folded condition and with the cover partly extended.
Figure 2:
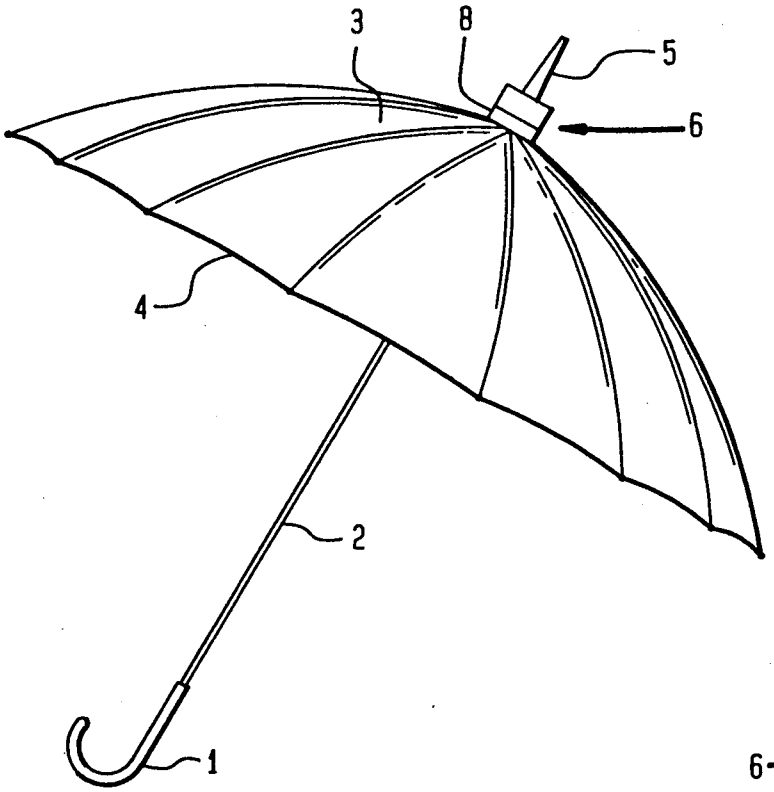
FIG. 2 is an elevation of the umbrella in use, in the opened out condition and with the cover fully retracted.
Figure 1:
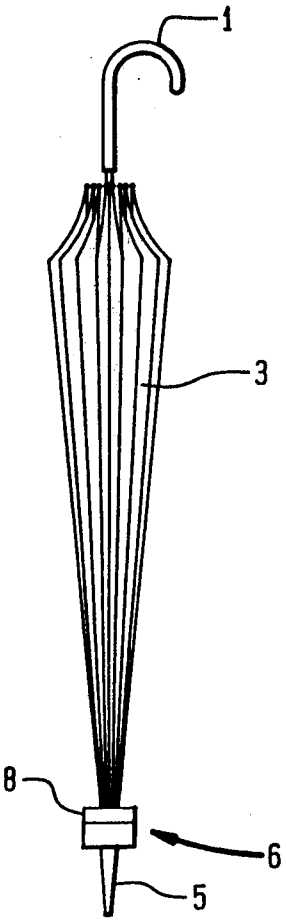
FIG. 1 is an elevation of an umbrella before use, in the folded condition and with the cover fully retracted.

Before use (see FIG. 1) and during use (see FIG. 2) the retractable cover 7 is in the retracted state in which it is contained in the housing formed by the drain cup 6 and rotatable hand grip 8. After use, the umbrella frame 3 is collapsed and the rotatable hand grip 8 is pulled along the umbrella in a spiral motion (see FIG. 3). The lengthwise movement of the rotatable hand grip 8 causes the cover 7 to extend in the manner of an accordion or bellows. The rotational movement of the rotatable hand grip 8 assists in folding the umbrella fabric 4 about the shaft 2. The folding of the fabric 4 reduces the friction between the rotatable hand grip 8 and the fabric 4 so that the cover can be rapidly and easily extended while the umbrella is held in the vertical position, and so that the rainwater on the fabric is gathered into the cover instead of being pushed lengthwise along the umbrella ahead of the hand grip. The outer diameter of the rotatable hand grip 8 is sufficiently large that the user's hand does not come into contact with the fabric 4. Once the cover 7 has been extended (see FIG. 4) it remains extended as a result of the light outward pressure of the umbrella fabric 4 against the rotatable hand grip 8. With the umbrella standing vertically rainwater drips down the umbrella fabric 4 and collects in the drain cup 6. Even if the umbrella is not standing vertically, for example if lying horizontally, the cover 7 contains the rainwater. The cover 7 is made from a single seamless length of plastic material and there are therefore no joints through which leakage might take place.

Figure 5:
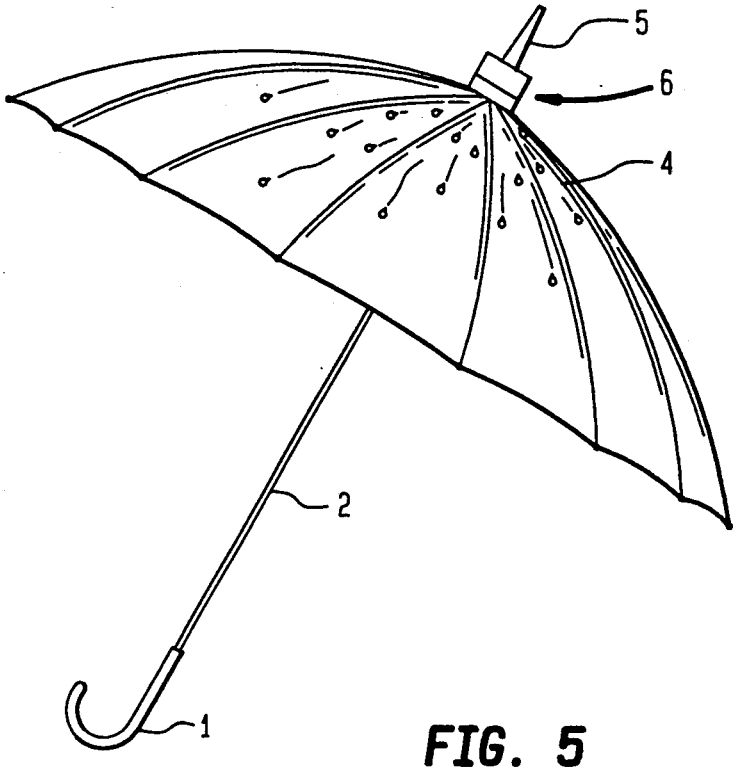
FIG. 5 an elevation of the umbrella at the start of next use, just after being opened out and with the cover fully retracted.

When it is next desired to use the umbrella, the umbrella is held vertically, that is to say with the tip 5 pointing downwards, the rotatable hand grip 8 is moved along the length of the umbrella to retract the cover 7 into the housing, the frame 3 and fabric 4 are moved to the erected state, and the umbrella in the erect state is then turned into the orientation for use, that is to say with the tip 5 pointing upwards (see FIG. 5). The rainwater then falls out of the drain cup 6 onto the top surface of the fabric 4 of the umbrella.

Figure 7:
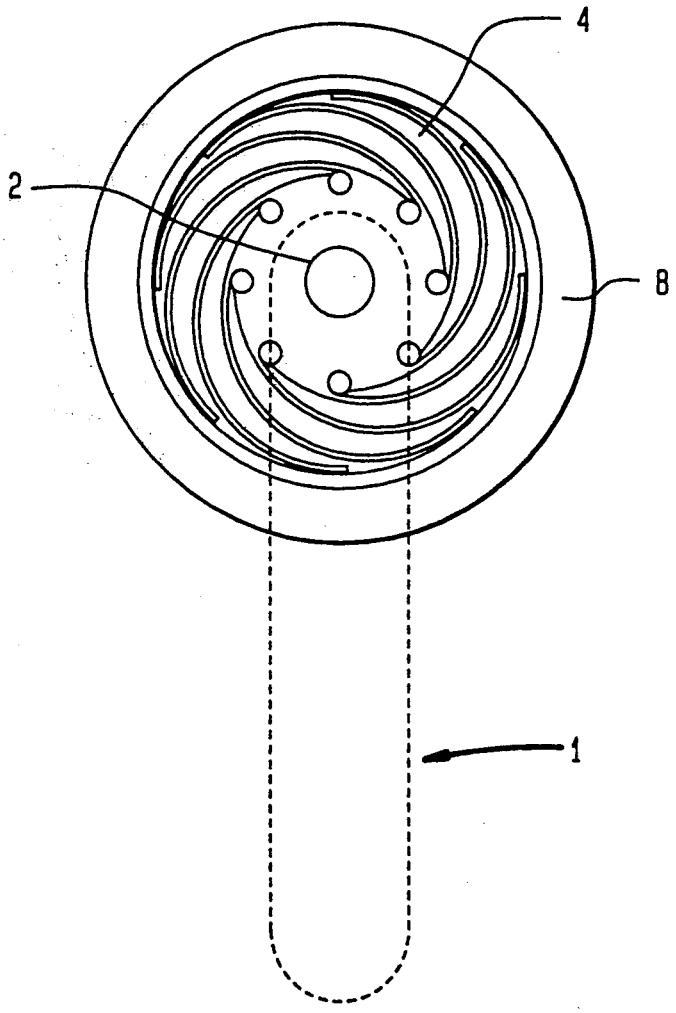
FIG. 7 is a plan view of the umbrella after use, in the folded condition and with the cover fully extended.

If the umbrella is not used for some time, for example overnight, the rainwater on the fabric 4 and in the drain cup 6 evaporates, so that the steps described in the preceeding paragraphs are not necessary. Evaporation is facilitated by the open spaces within the cover 7 arising from the accordion structure, which allows good ventilation within the cover, and evaporation is further facilitated by the relatively loose fit of the rotatable hand grip 8 on the fabric 4 which permits air to escape upwards between the folds of the fabric (see FIG. 7). The evaporation ensures that the umbrella does not remain wet for too long and the evaporation therefore extends significantly the life of the umbrella.

Figure 6:
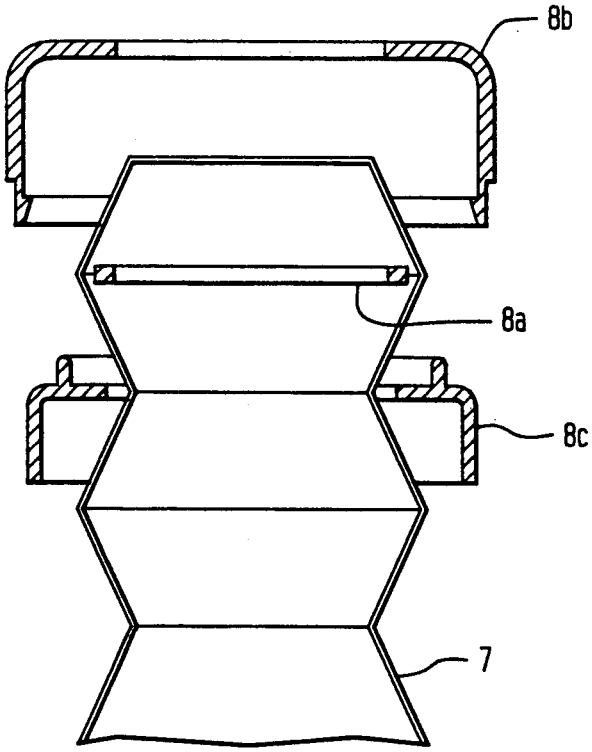
FIG. 6 is an exploded perspective view on a larger scale a detail of the umbrella.

Referring to FIG. 6 the rotatable hand grip 8 comprises three elements, which are shown in exploded cross section elevation. The three elements are an annulus 8*a*, an outer collar 8*b*, and an inner collar 8*c*. The rotatable hand grip 8 is assembled by locating the annulus 8*a* in the last fold of the cover 7, and then snap fitting the inner collar 8*c* into the outer collar 8*b*. The outer and inner collars 8*b* and 8*c* can then rotate relative to the annulus 8*a* and cover 7 while being secured in position in the end of the cover 7.

I claim:

1. An umbrella, comprising:

containment means at an outer end of the umbrella for containing rainwater that has moved down the umbrella when wet and closed, a waterproof and leakproof retractable cover means capable of being extended along the closed and wet umbrella so as to cover a substantial portion of canopy material of the umbrella and retain rainwater on the canopy material within the cover means for subsequent movement down into the containment means, and a collar that is formed by an inner member which is mounted to an outer member, with an end of the cover means being rotatably trapped between the inner and outer members.

2. An umbrella as claimed in claim 1 wherein the containment means is waterproof and leakproof.

3. An umbrella as claimed in claim 1 wherein the cover means is mounted to the containment means.

4. An umbrella as claimed in claim 1 wherein the containment means cooperates with the collar in order to form a housing for storing of water.

5. An umbrella as claimed in claim 1 wherein the cover means is extendable to a number of alternative extended positions along the folded canopy of the umbrella, the collar being held in position in each of these extended positions solely by the outward pressure of the folded canopy.

6. An umbrella as claimed in claim 1 wherein the cover means acts to guide rainwater to the containment means.

7. An umbrella as claimed in claim 1 wherein the cover means is unitary.

8. An umbrella as claimed in claim 7 wherein the cover means is made from a single seamless piece of material which is foldable.

9. An umbrella as claimed in claim 1 wherein the cover means loosely encloses the canopy of the umbrella to provide an air gap therearound.

10. An umbrella as claimed in claim 1 wherein the cover means is accordion shaped.

11. An umbrella as claimed in claim 1 wherein the side of the cover means is zig-zag shaped in cross section.

12. An umbrella as claimed in claim 1 wherein the arrangement is so designed and arranged that rainwater can only be removed through an open end of the cover means.

* * * * *